US010046194B2

(12) United States Patent
Celebrini et al.

(10) Patent No.: US 10,046,194 B2
(45) Date of Patent: Aug. 14, 2018

(54) CORE MUSCLE TRAINING APPARATUS AND METHOD

(71) Applicants: Richard George Celebrini, Burnaby (CA); Stephen J. Nash, Burnaby (CA); Gerald T. Cole, Burnaby (CA)

(72) Inventors: Richard George Celebrini, Burnaby (CA); Stephen J. Nash, Burnaby (CA); Gerald T. Cole, Burnaby (CA)

( * ) Notice: Subject to any disclaimer, the term of this patent is extended or adjusted under 35 U.S.C. 154(b) by 0 days.

(21) Appl. No.: 14/677,640

(22) Filed: Apr. 2, 2015

(65) Prior Publication Data

US 2015/0360076 A1 Dec. 17, 2015

(30) Foreign Application Priority Data

May 9, 2014 (CA) ..... 2851453

(51) Int. Cl.
*A63B 21/02* (2006.01)
*A63B 21/04* (2006.01)
(Continued)

(52) U.S. Cl.
CPC .... *A63B 21/0442* (2013.01); *A63B 21/00061* (2013.01); *A63B 21/0552* (2013.01);
(Continued)

(58) Field of Classification Search
CPC ..... A63B 21/00061; A63B 21/28; A63B 21/4009; A63B 21/4025; A63B 21/0428; A63B 21/055; A63B 21/169; A63B 21/04; A63B 21/0407; A63B 21/02; A63B 21/0442; A63B 23/02; A63B 21/0552; A63B 21/4043; A63B 21/00196; A63B 23/0405; A63B 23/047; A63B 2102/32;
(Continued)

(56) References Cited

U.S. PATENT DOCUMENTS 1,506,631 A * 8/1924 Grover ..... A63B 21/0004 482/124
3,458,188 A * 7/1969 Infante ..... G09B 19/0015 182/4
(Continued)

OTHER PUBLICATIONS

European Patent Office, Extended European Search Report dated Jan. 5, 2018 in European Patent Application No. EP15788931.2, 8 pages.

*Primary Examiner* — Joshua Lee
(74) *Attorney, Agent, or Firm* — Inskeep IP Group, Inc.

(57) ABSTRACT

A core muscle training apparatus and method is described. The apparatus comprises a harness that is worn by the user, to which a pair of resistance leads are connected at opposing sides of the user's waist approximately above the hips. A resistance force is applied through the resistance leads against an effort force exerted by the user in order to stimulate recruitment and activation of the targeted muscles. By adjusting the direction and the amount of resistance force applied to the resistance leads, the demand on the muscles being targeted can be controlled. The core muscle training apparatus according to embodiments of the present disclosure further offers versatility in the environment in which it can be used. The apparatus can be used, for example, when the user is in a static position or can be used during dynamic functional movements.

13 Claims, 14 Drawing Sheets

(51) Int. Cl.

| | |
|---|---|
| ***A63B 21/00*** | (2006.01) |
| ***A63B 21/28*** | (2006.01) |
| ***A63B 23/02*** | (2006.01) |
| ***A63B 23/04*** | (2006.01) |
| *A63B 21/055* | (2006.01) |
| *A63B 21/16* | (2006.01) |
| *A63B 69/00* | (2006.01) |
| *A63B 102/32* | (2015.01) |

(52) U.S. Cl.
CPC ..... *A63B 21/28* (2013.01); *A63B 21/4009* (2015.10); *A63B 23/02* (2013.01); *A63B 23/0405* (2013.01); *A63B 21/00196* (2013.01); *A63B 21/02* (2013.01); *A63B 21/04* (2013.01); *A63B 21/0407* (2013.01); *A63B 21/0428* (2013.01); *A63B 21/055* (2013.01); *A63B 21/169* (2015.10); *A63B 21/4025* (2015.10); *A63B 21/4043* (2015.10); *A63B 23/047* (2013.01); *A63B 69/002* (2013.01); *A63B 69/004* (2013.01); *A63B 69/0024* (2013.01); *A63B 69/0028* (2013.01); *A63B 69/0071* (2013.01); *A63B 2102/32* (2015.10); *A63B 2209/10* (2013.01); *A63B 2244/22* (2013.01)

(58) Field of Classification Search
CPC ..... A63B 2209/10; A63B 69/002; A63B 69/0024; A63B 69/0028; A63B 69/0071; A63B 69/004; A63B 2244/22
See application file for complete search history.

(56) References Cited

U.S. PATENT DOCUMENTS 4,073,490 A * 2/1978 Feather ..... A61H 11/00 482/129
4,685,671 A * 8/1987 Hagerman ..... A63B 21/04 482/124
4,968,028 A * 11/1990 Wehrell ..... A63B 5/16 482/124
5,080,191 A 1/1992 Sanchez
5,306,222 A * 4/1994 Wilkinson ..... A41D 13/0015 482/121
5,362,295 A * 11/1994 Nurge ..... A63B 21/00061 482/121
5,397,122 A * 3/1995 Herridge, II ..... A63B 21/0004 473/212
5,613,926 A * 3/1997 Michaelson ..... A63B 21/0552 482/121
5,647,827 A * 7/1997 Gutkowski ..... A63B 21/0004 482/122
5,803,881 A * 9/1998 Miller ..... A63B 21/0004 482/124
5,813,955 A * 9/1998 Gutkowski ..... A63B 21/0004 482/121
5,820,533 A * 10/1998 Goldman ..... A63B 21/0552 482/124
6,012,993 A * 1/2000 Guerriero ..... A63B 21/0552 182/3
6,270,430 B1 * 8/2001 Nicoloff ..... A63B 69/0026 473/207
6,551,221 B1 * 4/2003 Marco ..... A63B 21/0004 280/600
7,384,382 B2 * 6/2008 Farrah ..... A63B 21/153 273/453
7,707,652 B2 * 5/2010 Senegal ..... A63B 21/0552 2/102
8,992,399 B2 * 3/2015 Wehrell ..... A61H 1/0229 482/121
9,011,156 B2 * 4/2015 Hallmark ..... A63B 69/0002 434/247
9,242,159 B1 * 1/2016 Lacoste ..... A63B 69/0002
9,421,412 B2 * 8/2016 Eddy ..... A63B 21/002
2002/0068667 A1 * 6/2002 Strachan ..... A63B 21/0004 482/124
2003/0220160 A1 11/2003 Clark et al.
2004/0152569 A1 * 8/2004 Lerner ..... A63B 21/0552 482/124
2007/0015640 A1 * 1/2007 Demeniuk ..... A63B 21/0004 482/124
2008/0194390 A1 * 8/2008 Todd ..... A63B 21/00185 482/124
2008/0300118 A1 * 12/2008 Wehrell ..... A63B 21/04 482/129
2010/0279830 A1 * 11/2010 Snagg ..... A63B 21/0552 482/124
2010/0292051 A1 * 11/2010 Benumof ..... A61H 1/0296 482/10
2011/0021329 A1 * 1/2011 Dunne ..... A63B 21/0552 482/124
2011/0250979 A1 * 10/2011 Dean ..... A63B 69/0057 473/207
2012/0245002 A1 * 9/2012 Todd ..... A63B 21/4025 482/124
2013/0079203 A1 * 3/2013 Jones ..... A63B 5/16 482/130
2013/0130866 A1 * 5/2013 Wehrell ..... A63B 21/1403 482/5
2013/0244835 A1 * 9/2013 Thompson ..... A63B 21/062 482/8
2013/0333097 A1 * 12/2013 Cranke ..... A63B 21/0557 2/300
2014/0087926 A1 * 3/2014 Gutierrez ..... A63B 21/02 482/121
2014/0200499 A1 * 7/2014 Champion ..... A63B 21/151 602/36
2015/0031511 A1 * 1/2015 Matthews ..... A63B 21/0557 482/124
2015/0065317 A1 * 3/2015 Washington ..... A63B 21/0442 482/124
2015/0251038 A1 * 9/2015 Bybee ..... A63B 21/0442 482/124
2015/0251040 A1 * 9/2015 Pinder ..... A63B 21/0407 482/124
2015/0360070 A1 * 12/2015 Morrissey ..... A63B 21/0552 482/124
2017/0304668 A1 * 10/2017 Banks ..... A63B 23/04

* cited by examiner

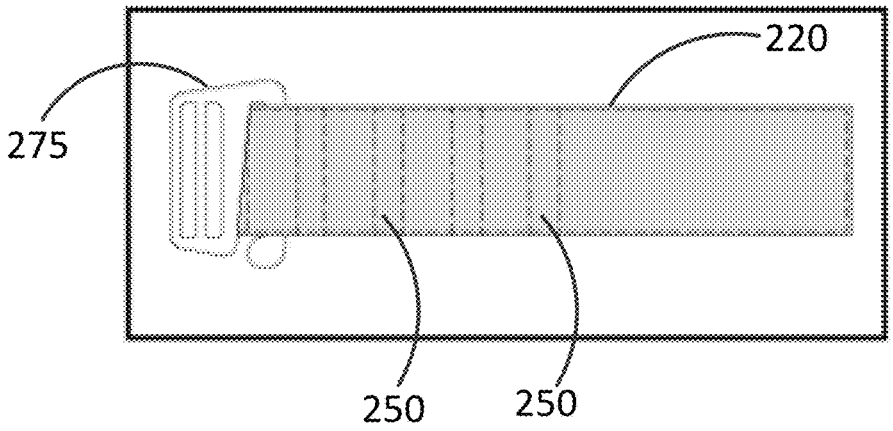
FIGURE 12C
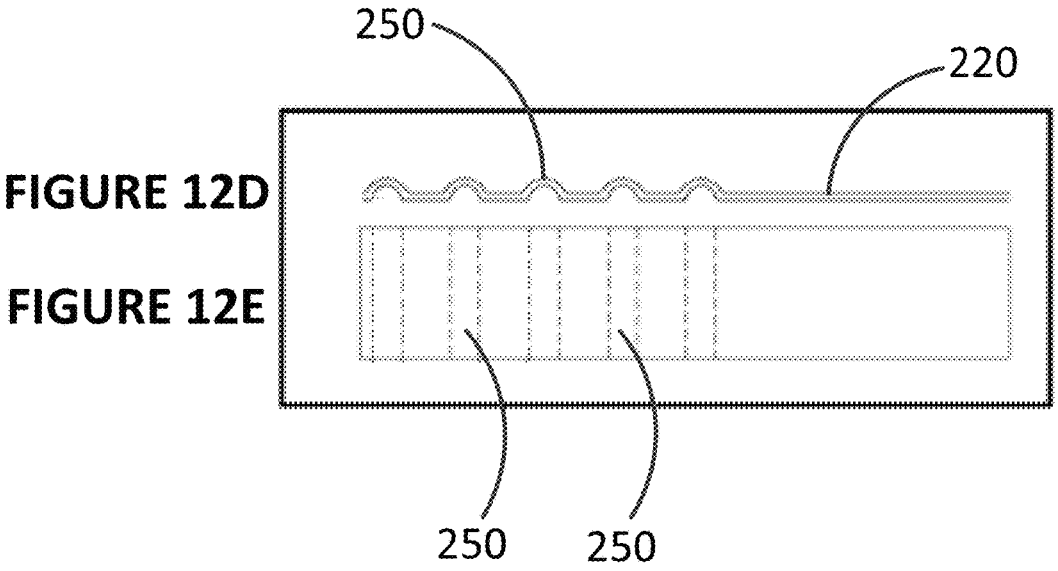
FIGURE 12D
FIGURE 12E

U.S. Patent Aug. 14, 2018 Sheet 14 of 14 US 10,046,194 B2

1
2
3
4

—X—

CORE MUSCLE TRAINING APPARATUS AND METHOD

FIELD OF THE INVENTION

The present invention relates to the field of exercise and training systems and, in particular, to an apparatus and method for core muscle training essential for full body training and improvement in overall body movement.

BACKGROUND OF THE INVENTION

The "core muscles" are a group of muscles that run the length of the trunk and torso to stabilize the spine, pelvis, and shoulder girdle. The muscles are found in the oblique and abdominal regions, lower back, and the gluteus muscle region. Together these muscles provide a solid foundation for supporting proper body alignment or posture, enable powerful movements of the extremities, help in the control of movements, the transfer of energy, the shift in body weight and the ability to move in any direction. Thus, the benefits of strengthening the core are important for full body training and improvement in body movement for developing both functional fitness essential to daily living and regular activities, as well as for developing high level athletic performance.

Strength, power, speed, quickness, agility, and coordination are critical for performance in almost all sports and activities, and all depend from the core muscles of the body. It is the core muscles of the body that connect all movements of the upper and lower body. Powerful and efficient movements of the extremities require a transfer of force through the body to achieve maximum acceleration of an appendage. This transfer of force is often a function of how well the upper and lower body are connected. By strengthening the core muscles, therefore, a solid unit is created that is capable of developing and transferring forces from the legs through the trunk to the arms. The sum of these integrated forces results in optimal acceleration. This is known as the kinetic-link or kinetic-chain principle. A few major sports in which this transfer of forces is particularly critical include baseball, golf, basketball, hockey, football, and tennis.

For these reasons, exercise and training for the whole body has focused on developing and maintaining strong core muscles. Such core strengthening exercises have been developed and are based on achieving recruitment and activation of core muscle function. Typically, such exercises are static and involve techniques that include perturbation training and neuromuscular facilitation to activate and integrate core muscle control, movement, and stability. For example, the use of resistance bands, medicine balls and balance boards have been used to target and isolate specific core muscle groups.

Exercise apparatus have also been described for targeting the core muscles. For example, United States Patent Publication No. 2013/0095987 describes an exercise apparatus that combines strength training and a core workout into one exercise module. The apparatus is described as containing a compressible member consisting of a durable exterior shell with an interior containing a liquid gel or gas. The volume and/or pressure inside the compressible member containing the liquid or gel may be changed to allow for varying levels of stability while performing exercises. When the apparatus is in use during exercise, or when the compressible member is worn by the exercising person, the compressible member causes physical instability during performance of a resistance-based exercise that requires the exercising person to use the core muscles to maintain balance and proper form. The apparatus, however, focuses on the muscles in the abdomen, back, and buttocks and does not stimulate rotational demand, thereby neglecting recruitment of the transversus abdominus and oblique muscles of the core. Accordingly, the apparatus does not offer multidirectional stimulation in particular in the rotational plane.

U.S. Pat. No. 7,833,140 describes a core resistance apparatus that comprises resistance cords that are secured to the user's wrists and thighs, for example, to provide a linear resistance force between two connections on the user. When the user moves or rotates, the movement generated by an extremity will produce an immediate force on the opposite extremity that increases recruitment and contraction of all the intrinsic core muscles, making the lower and upper extremities connected under resistance forces. Controlled resistance in stabilizing the movement from the opposite limb reinforces the muscle recruitment in the core muscles and also assists in maintaining a balance and a steady center of gravity. While the described resistance apparatus does offer stimulation of the rotational plane, the apparatus is cumbersome to use and cannot easily be adapted for use in dynamic functional movements or sport specific exercises.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

Disclosed herein are exemplary embodiments pertaining to a core muscle training apparatus and method. In accordance with one aspect of the disclosure, there is described a core muscle training apparatus, comprising: a harness to be worn by a user, the harness adapted to be fittingly secured around the user's midsection; and a pair of resistance leads comprising a first end, each first end of the pair attachable to the harness at opposing sides of the user's midsection, the resistance leads adapted at a second end for effecting a resistance force against an effort force exerted by the user; wherein when the resistance force is applied through the resistance leads recruitment and activation of core muscles is stimulated.

In accordance with another aspect, there is described a core muscle training apparatus, comprising: a harness to be worn by a user, the harness adapted to be fittingly secured around the user's midsection; webbing on the exterior surface of the harness for securing the harness around the midsection of the user; at least one pair of connectors fastened to the webbing on the exterior surface of the harness; and a pair of resistance leads comprising a first end, each first end of the pair attachable to the at least one pair of connectors on the exterior surface of the harness such that the pair of resistance leads is secured to the harness at opposing sides of the user's midsection, the resistance leads adapted at a second end for effecting a resistance force against an effort force exerted by the user; wherein when the resistance force is applied through the resistance leads recruitment and activation of core muscles is stimulated.

In accordance with another aspect, there is described a core muscle training system comprising: the apparatus according to embodiments described in the present disclosure; and interchangeable pairs of resistance leads having differing resistancy tensions; wherein each pair of resistance leads can be interchanged to vary the resistance force being applied to the user.

In accordance with another aspect, there is described a method for core muscle training comprising: providing the apparatus according to embodiments described in the present disclosure, wherein the harness is worn by the user and the second end of the pair of resistance leads is held by a training partner; and applying a resistance force to the pair of resistance leads to stimulate recruitment and activation of core muscles; wherein the direction that the resistance force is applied is adjusted by the positioning of the resistance leads relative to the user.

In accordance with another aspect, there is described a method for core muscle training comprising: providing the apparatus according to embodiments described in the present disclosure, wherein the harness is worn by the user and the second end of the pair of resistance leads is fixed to a stationary fixture; and applying an effort force to the pair of resistance leads to stimulate recruitment and activation of core muscles; wherein the direction that the effort force is applied is adjusted by the positioning of the user relative to the fixed resistance leads.

In accordance with a further aspect, methods according to embodiments described in the present disclosure can be used during static positioning of the user as well as during dynamic functional movement of the user. In accordance with another aspect, the methods according to embodiments described in the present disclosure can be used during sport specific dynamic functional movement of the user.

BRIEF DESCRIPTION OF THE DRAWINGS

These and other features of the invention will become more apparent in the following detailed description in which reference is made to the appended drawings.

FIGS. 12A, 12B, 12C, 12D, and 12E are perspective views of the apparatus, according to further embodiments of the present disclosure wherein FIG. 12A is a perspective view of the exterior surface of the apparatus, FIG. 12B is a perspective view of the interior surface of the apparatus, FIG. 12C is an isolated view of the closure mechanism according to certain embodiments of the present disclosure, and FIGS. 12D and 12E are side and perspective views of the 'bullet holes' type closure mechanism shown in FIG. 12C, according to embodiments of the present disclosure.

DETAILED DESCRIPTION OF THE INVENTION

Definitions

Figure 1:
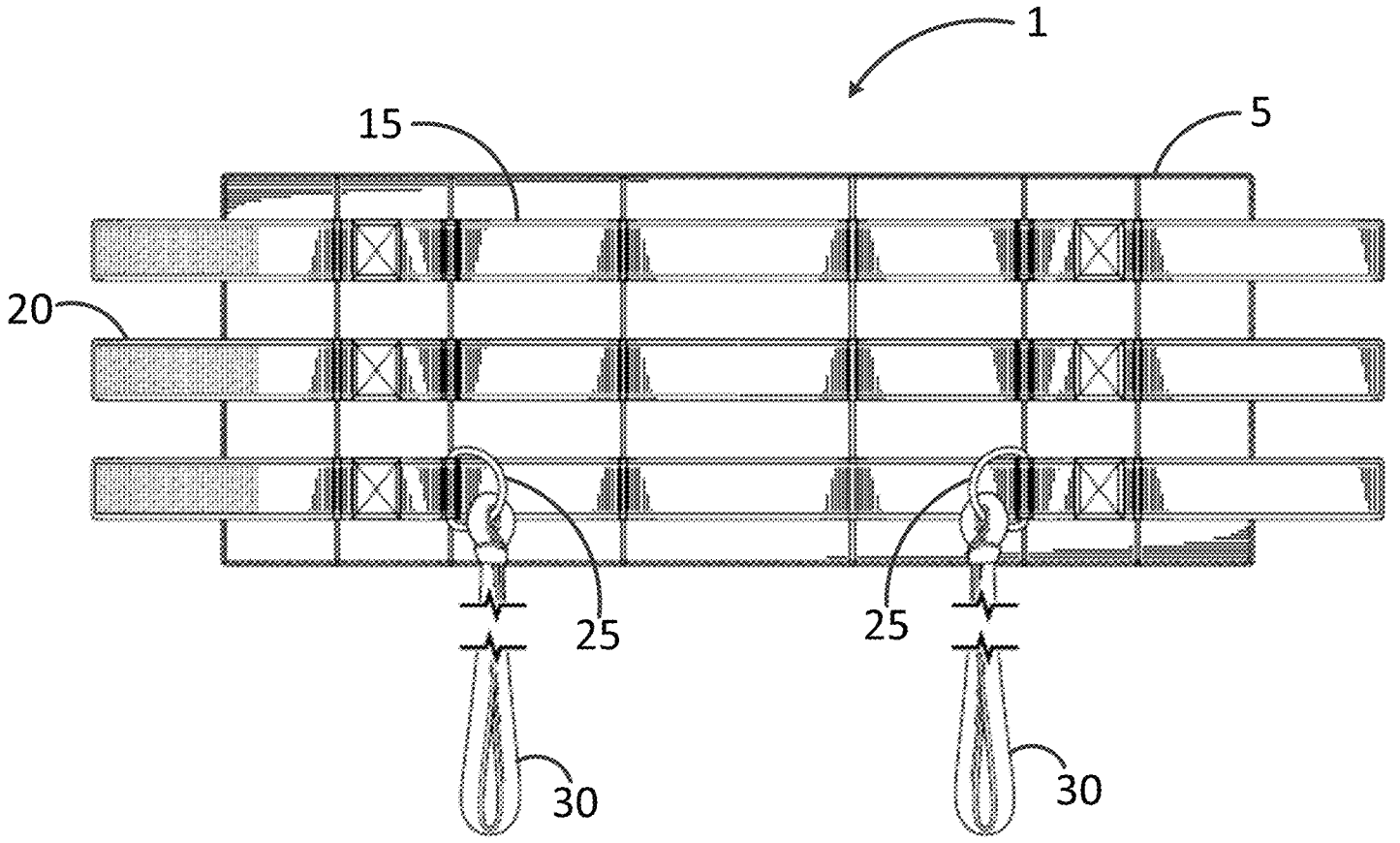
FIG. 1 is a perspective view of the apparatus illustrating the outer surface of the harness having Velcro securing means, according to embodiments of the present disclosure.

Unless defined otherwise, all technical and scientific terms used herein have the same meaning as commonly understood by one of ordinary skill in the art to which this invention belongs.

As used herein, the term "about" refers to an approximately ±10% variation from a given value. It is to be understood that such a variation is always included in any given value provided herein, whether or not it is specifically referred to.

The core muscle training apparatus according to the present disclosure is based on the concept of stimulating core muscles in a targeted manner. According to embodiments of the present disclosure, the apparatus allows resistance to be controllably applied to the user's movements. By controlling the resistance tension, embodiments of the present disclosure allow a targeted workload to be added to the core muscles or alternatively facilitate optimal movement of the user. For example, by reducing the resistance tension being applied at specific moments of a movement pattern, preferential recruitment and timing of core muscles is enhanced by facilitating optimal movement of the user.

According to embodiments of the present disclosure, the apparatus comprises a harness that is worn by the user, to which a pair of resistance leads are connected at opposing sides of the user's waist approximately above the hips. A resistance force is applied through the resistance leads against an effort force exerted by the user in order to stimulate recruitment and activation of the targeted muscles.

The design of the apparatus allows stimulation of the core muscles in all planes, including horizontal, vertical, lateral, and rotational planes. The direction that the resistance force is applied will determine which muscles are being stimulated. According to certain embodiments, the direction of the resistance force can be controlled by the positioning of the resistance leads relative to the user. For example, when resistance is applied in a rotational plane, the apparatus stimulates a rotational demand that preferentially recruits the transversus abdominus muscles of the core. In this way, the apparatus of the present disclosure permits stimulation of the core muscles in a targeted and timed manner. Similarly, by adjusting the amount of resistance force applied to the resistance leads will adjust the demand on the muscles being targeted and the intensity of the exercise. The apparatus, therefore, allows the intensity of the stimulation to be adjusted to the needs of the user.

The combination of the harness and the placement of the resistance leads at each side of the user's body, allows the application of a resistance force to be distributed across the midsection of the user; in this way, minimizing the tendency of the user's body to hinge when a resistance force is applied. Instead, the distribution of the resistance force across the midsection of the user ensures that the upper and lower portions of the user's body remain connected and correct body posture is maintained throughout an exercise. By maintaining this connection, a multidirectional demand on the core muscles is created to specifically stimulate recruitment and activation of core muscle function.

According to embodiments of the present disclosure, the position of the resistance leads about the user's midsection can be adjusted as desired. For example, it may be desired to position the leads at the front and back of the user's body instead of at opposing sides of the user's body. In this way, the direction that the resistance force is applied can be varied. In such embodiments, the harness may be adapted with multiple connectors to allow attachment of the resistance leads at various locations about the user's body. According to other embodiments, the harness can simply be slidingly rotated around the user's midsection to adjust the location of the resistance leads relative to the user's body.

The core muscle training apparatus according to the present disclosure further offers versatility in the environment in which it can be used. The apparatus can be used, for example, when the user is in a static position. Due to its unencumbered design, however, the apparatus can also be used during dynamic functional movements. In addition, according to certain embodiments, the apparatus can be used during dynamic sport specific activities, for example and without limitation, activities related to basketball, hockey, soccer, golf, and tennis. As well, according to other embodiments, the apparatus can be used during dance and martial arts training for example. Thus, the apparatus according to the present disclosure can be applied to a wide-ranging variety of training programs that can include rehabilitative therapy, general fitness programs, intensive athletic training, and even dynamic performing arts training.

Apparatus

Figure 2:
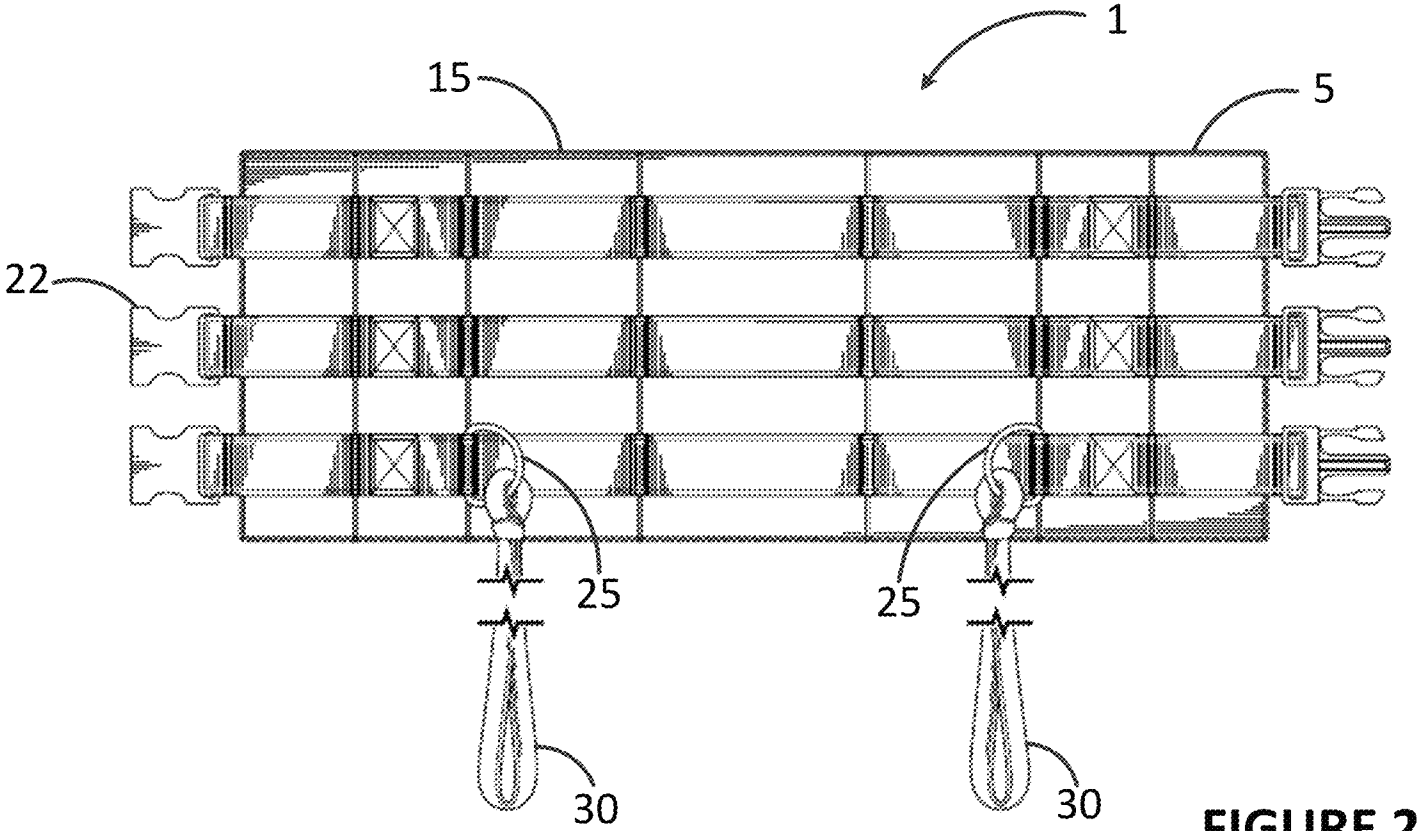
FIG. 2 is a perspective view of the apparatus illustrating the outer surface of the harness having a buckle clip securing means, according to embodiments of the present disclosure.
Figure 3:
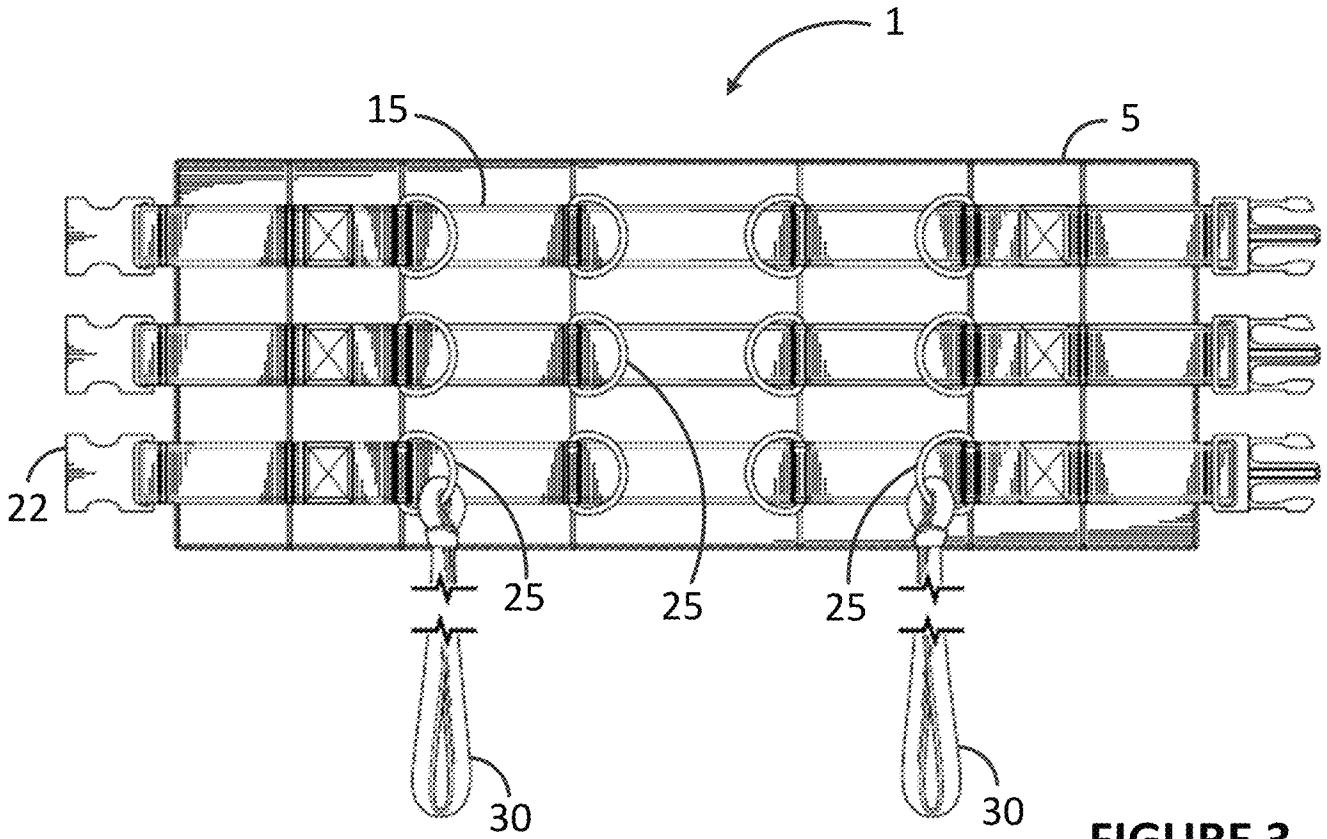
FIG. 3 is a perspective view of the apparatus illustrating the outer surface of the harness displaying multiple connectors, according to embodiments of the present disclosure.
Figure 4:
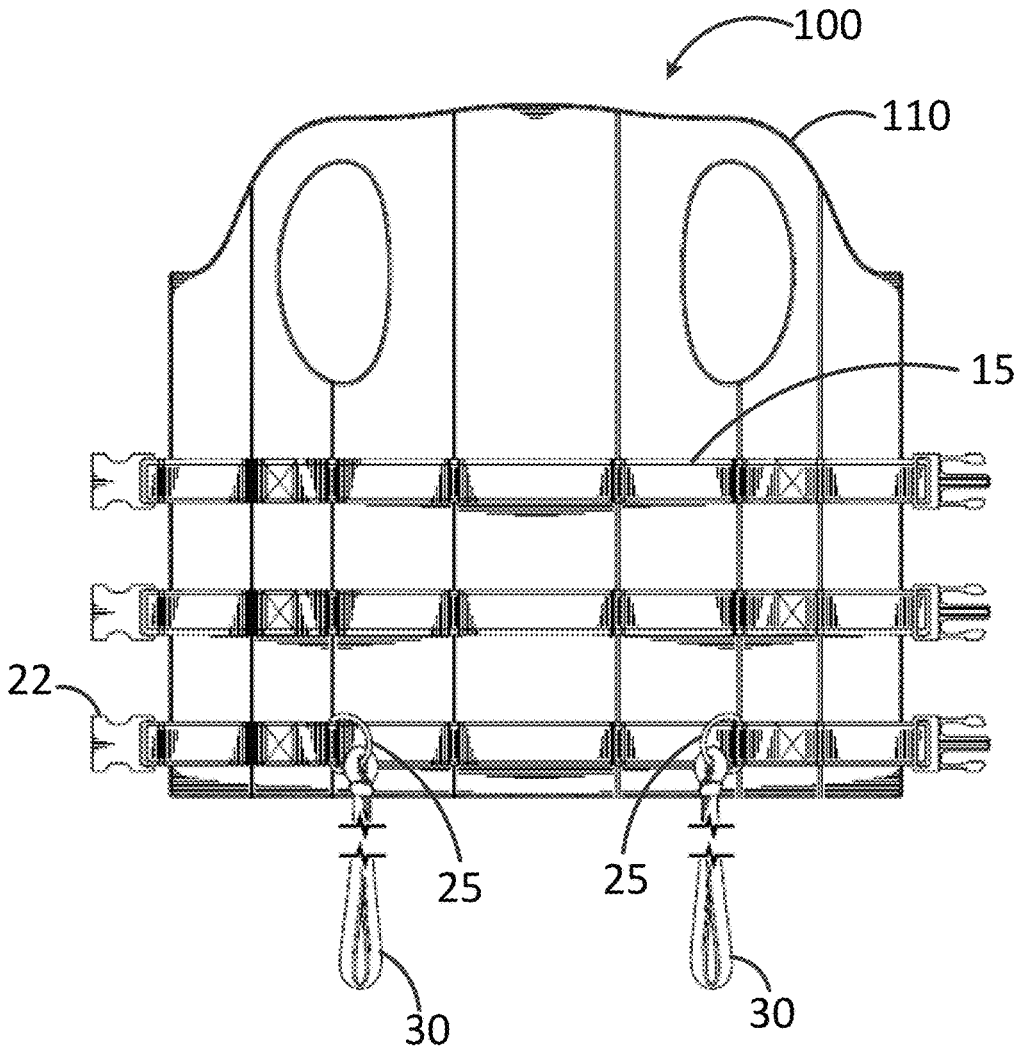
FIG. 4 is a perspective view of the apparatus according to embodiments of the present disclosure in which the harness is configured as a vest.

Referring now to the drawings, in which like reference numerals identify identical or substantially similar parts throughout the several views, FIGS. 1 to 4, and 9 to 12, illustrate perspective views of the apparatus 1, 100, 200 according to embodiments of the present disclosure. The apparatus 1, 100, 200 comprises a harness 5, 110, 205 to be worn by a user. The harness 5, 110, 205 is adapted to be fittingly secured around the user's midsection and can take a variety of forms to adapt to the user's comfort. For example, according to certain embodiments the harness can take the form of a belt 5, 205 to be securely fastened around the user's midsection (FIGS. 1 to 3, and 9 to 12). In other embodiments, the harness can take the form of a vest 110 (FIG. 4).

The harness 5, 110, 205 is made of a resilient, body-forming material to ensure that the harness 5, 110, 205 conforms to the shape of the user's body while having sufficient resiliency to withstand the resistance forces applied when in use. The harness 5, 110, 205 is further configured to maintain position on the user's body when in use such that the harness 5, 110, 205 does not shift around the user's body when resistance force is applied. Accordingly, in some embodiments, the harness 5, 110, 205 is made from materials that have a friction coefficient that is sufficient to minimize slippage around the user's body. Such materials are known in the art, and generally include fabrics that comprise elastomeric fibres such as neoprene, spandex, Lycra™, and combinations thereof. According to certain embodiments of the present disclosure, non-slippage material can be applied to such elastomeric fabrics to further minimize slippage or movement of the apparatus around the user's midsection. According to such embodiments, silicone can be applied to the inner surface of the harness to minimize slippage.

Figure 10A:
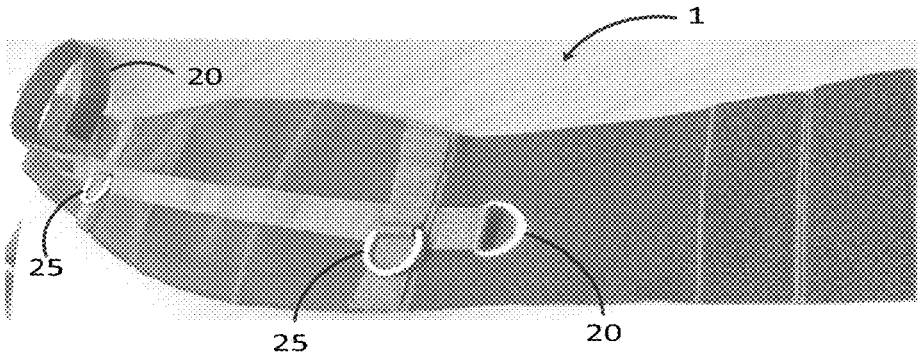
FIGS. 10A and 10B are perspective views of the apparatus shown in FIGS. 9A and 9B in an opened position (10A) and a closed position (10B), according to embodiments of the present disclosure.
Figure 10B:
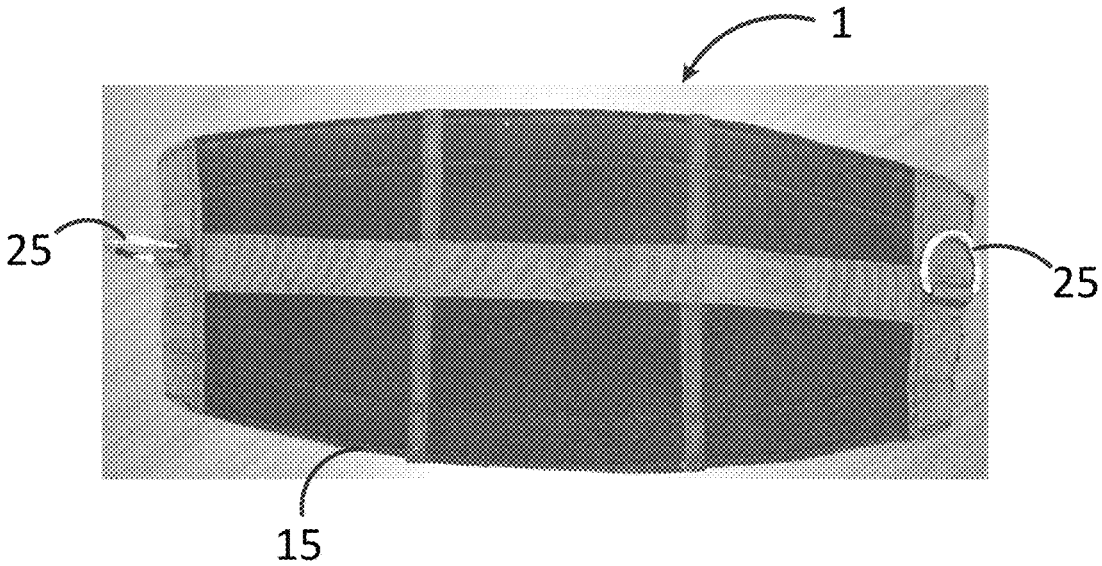
Figure 12A:
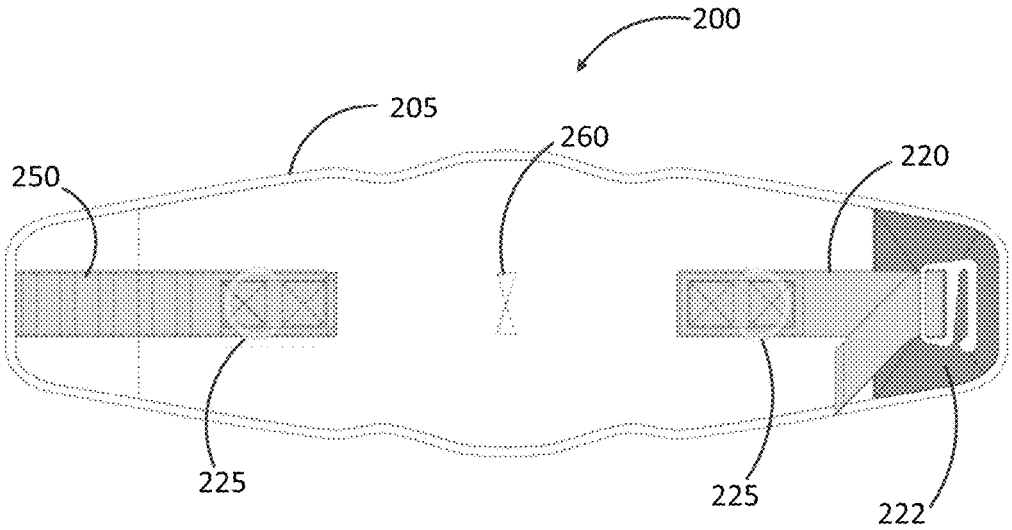
Figure 12B:
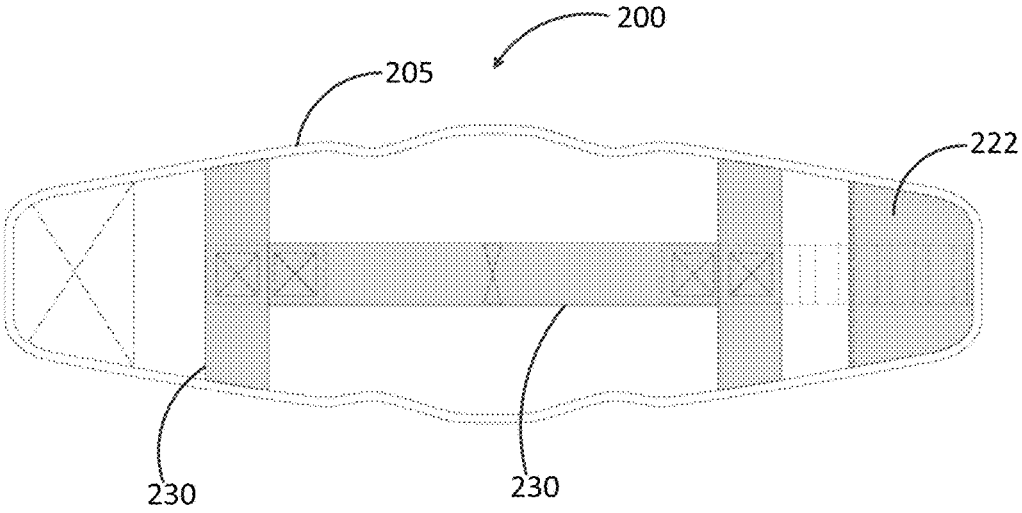

According to embodiments of the present disclosure, the harness can comprise multiple panels that are attached together to form the complete body conforming harness (FIGS. 10A and 10B). According to other embodiments, the harness 205 can comprise a unitary piece that is shaped to conform to a user's body (FIGS. 12A and 12B). Utilizing a unitary harness 205 can, according to certain embodiments of the present disclosure, minimize weakening of the harness material.

Figure 9A:
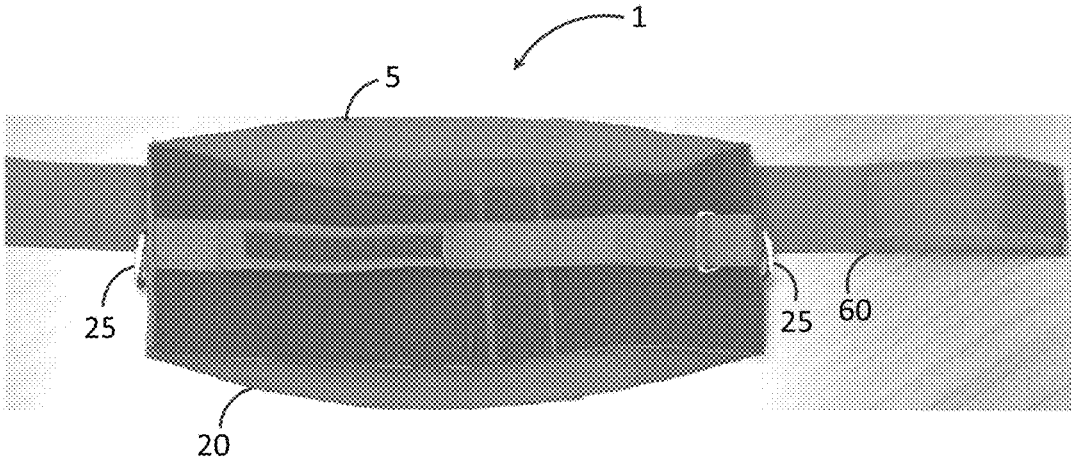
FIGS. 9A and 9B are perspective views of the apparatus, according to embodiments of the present disclosure.
Figure 9B:
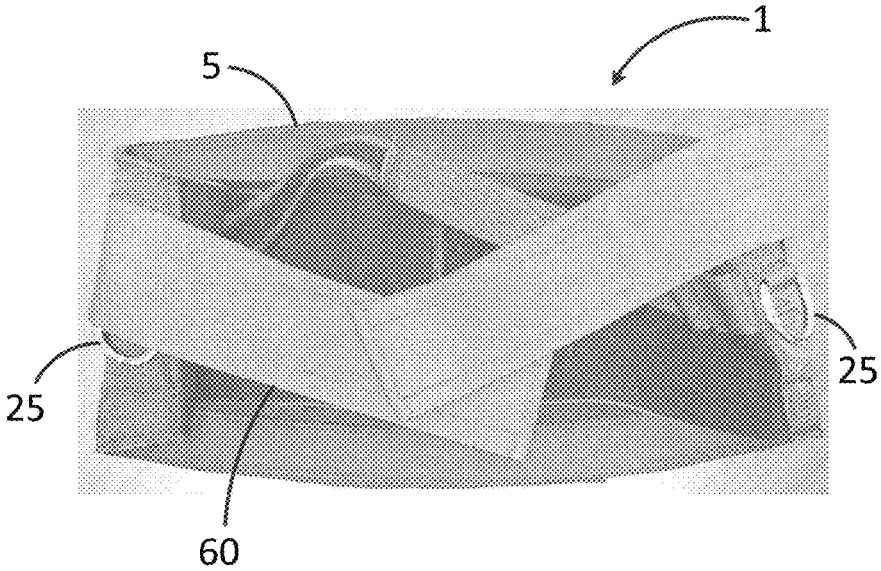
Figure 11A:
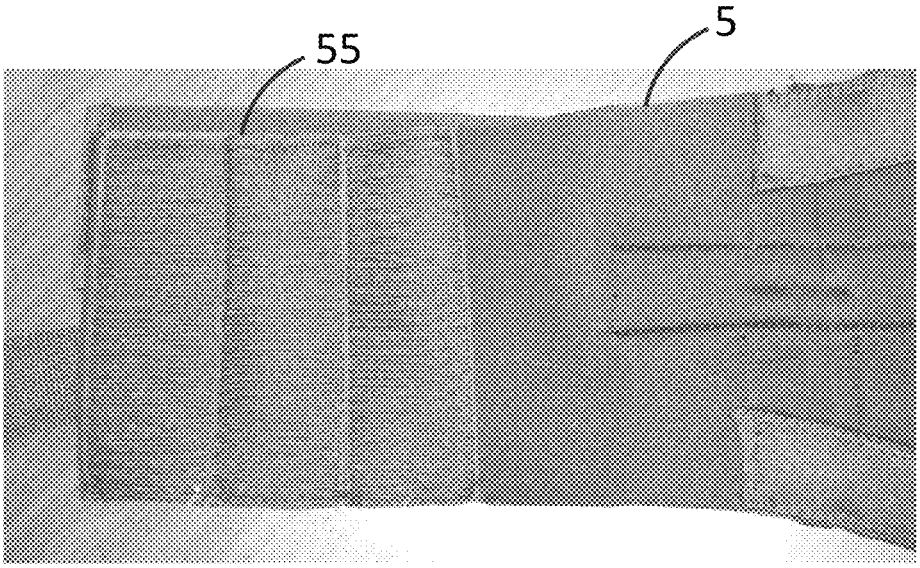
FIGS. 11A and 11B are perspective views of the corresponding ends of the apparatus shown in FIGS. 9A and 9B, configured for securing the harness around the user's body, according to embodiments of the present disclosure.
Figure 11B:
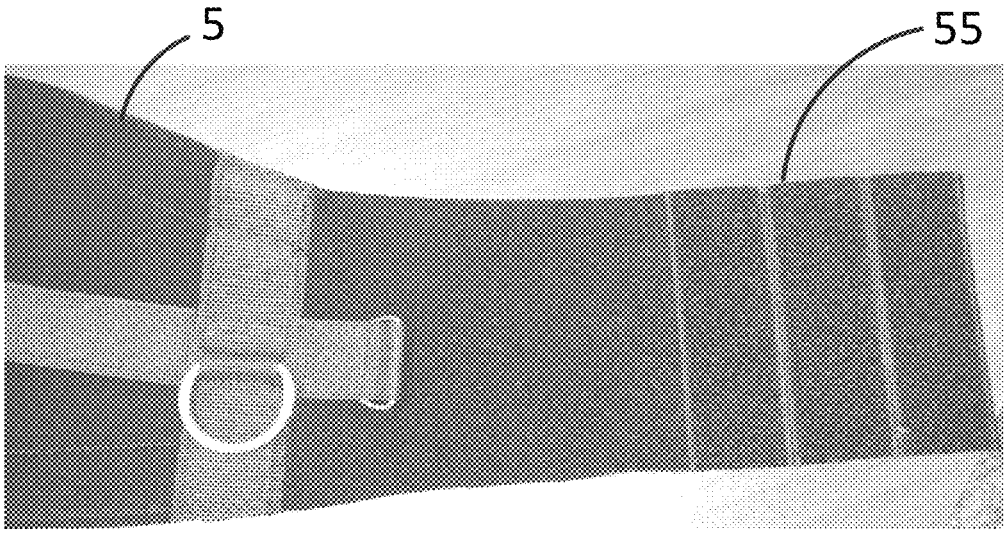

Securing means on the harness 5, 110, 205 ensures that the harness 5, 110, 205 can be fittingly secured into position around the user's midsection. The securing means can be adjustable to allow the harness 5, 110, 205 to be sized to fit the particular user. In certain embodiments, as shown in FIGS. 1 to 4 and 9 to 12, the securing means comprise webbing 15, 220 that can be fastened by various fasteners 20, 275 known in the art, including for example Velcro 20, 222 (as shown in FIGS. 1 and 12), and buckle clips 22 (as shown in FIGS. 2, 3, and 4). According to further embodiments (as shown in FIGS. 11A and 11B), the harness 5 comprises Velcro extensions 55 at its ends that allow the harness to be wrapped around the user's torso and secured into place. According to certain embodiments, the harness 5 can include various combinations of such securing means. For example, as shown in FIGS. 9A and 9B, the apparatus 1 can include a combination of Velcro extensions 55 in addition to webbing that is fastened overtop. In further embodiments, the securing means can also include an additional fastening belt 60 for added security. According to other embodiments, as shown in FIGS. 12A, 12C, and 12D, the securing means can be simplified to a hook-type fastener 275 attached at one end of the webbing 220 for insertion into a corresponding 'bullet hole' 250 that is stitched at predetermined distances apart in the cooperating end of the webbing 220 to fasten the harness 205 at the desired sizing in a hook-like manner. According to certain embodiments, the apparatus can comprise a combination of a hook-type fastener and a Velcro fastening means (FIG. 12B).

According to certain embodiments, the webbing 15 comprises one or more straps fixed to the exterior of the harness 5 to provide structural support to the harness 5. According to such embodiments, the webbing straps 15 comprise material that is less elastic than the harness 5, for example woven cotton or nylon, to provide the structural support. The webbing 15 can be fixedly applied to the harness 5 in any number of configurations that provide structural support to the harness 5. For example, as shown in the embodiments illustrated in FIGS. 1 to 4, the webbing 15 can be fixedly applied horizontally across the length of the harness 5. In other embodiments, for example as shown in the embodiments illustrated in FIGS. 10A and 10B, the webbing 15 can be fixedly applied vertically at various points along the surface of the harness 5 to provide structural support. In further embodiments, the webbing 15 can be fixedly applied in a combination of vertical and horizontal positions. According to certain embodiments of the present disclosure, as illustrated in FIGS. 12A and 12B, the amount of webbing 230 can be minimized and attached to the harness 205 on the inside surface in order to minimize weakening of the harness material. In such embodiments, the amount of stitching 260, for example, used to attach the webbing 230 to the harness 205 can further be minimized to strategically positioned locations on the harness 205 to further minimize weakening of the harness material.

At least one pair of connectors 25, 225 are disposed on the exterior surface of the harness 5, 110, 205 to allow attachment of a pair of resistance leads 30. As shown in the embodiments illustrated in FIGS. 1 and 3, 10A and 10B, and 12A, the connectors 25, 225 are fastened to the webbing straps 15, 220 which provide the structural support required in order to ensure that the connectors 25, 225 remain secured to the harness 5, 110, 205 under the resistance forces applied during use. The pair of connectors 25, 225 are located on the exterior surface of the harness 5, 110, 205 to allow a pair of resistance leads 30 to be attached to the harness 5, 110, 205 at opposing sides of the user's midsection at about the user's waist. According to certain embodiments (FIGS. 1 and 9 to 12), the harness 5, 110, 205 can include one pair of connectors 25, 225. As shown in FIG. 3, other embodiments can include multiple pairs of connectors 25 disposed on the exterior surface of the harness 5, whereby multiple points of attachment are available for attachment of the resistance leads 30. In this way, different users can be accommodated by a single apparatus 1.

Figure 5:
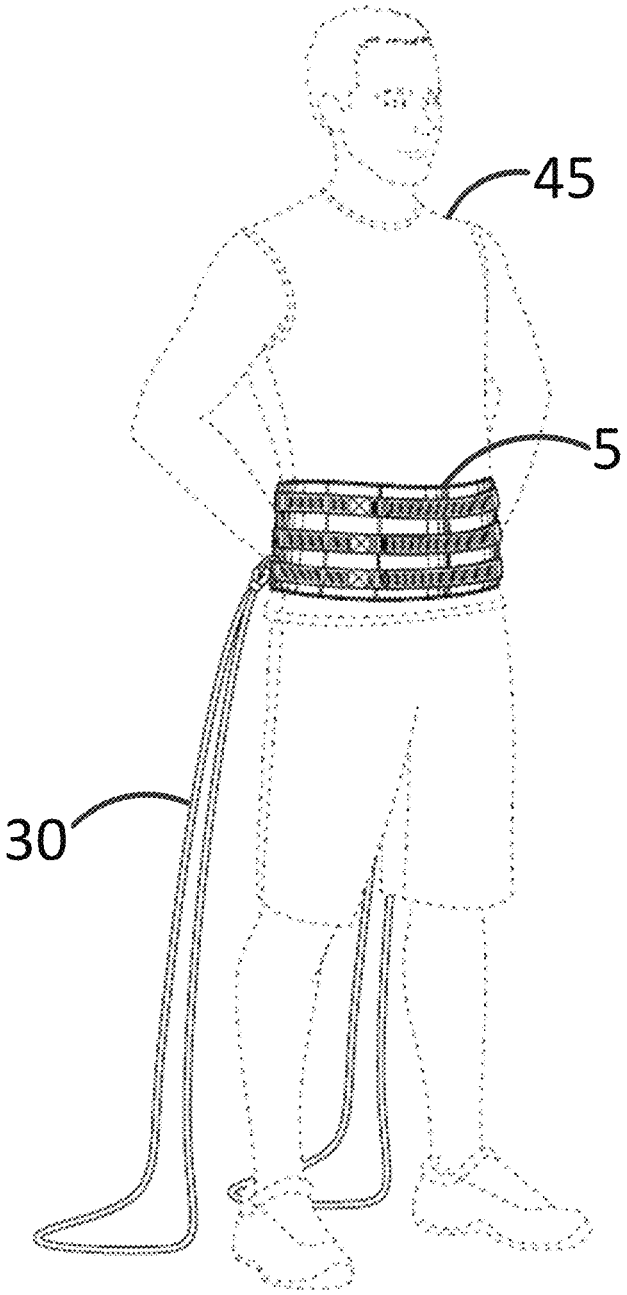
FIG. 5 is a perspective view of the apparatus secured to the midsection of a user in a static position, according to embodiments of the present disclosure.
Figure 6:
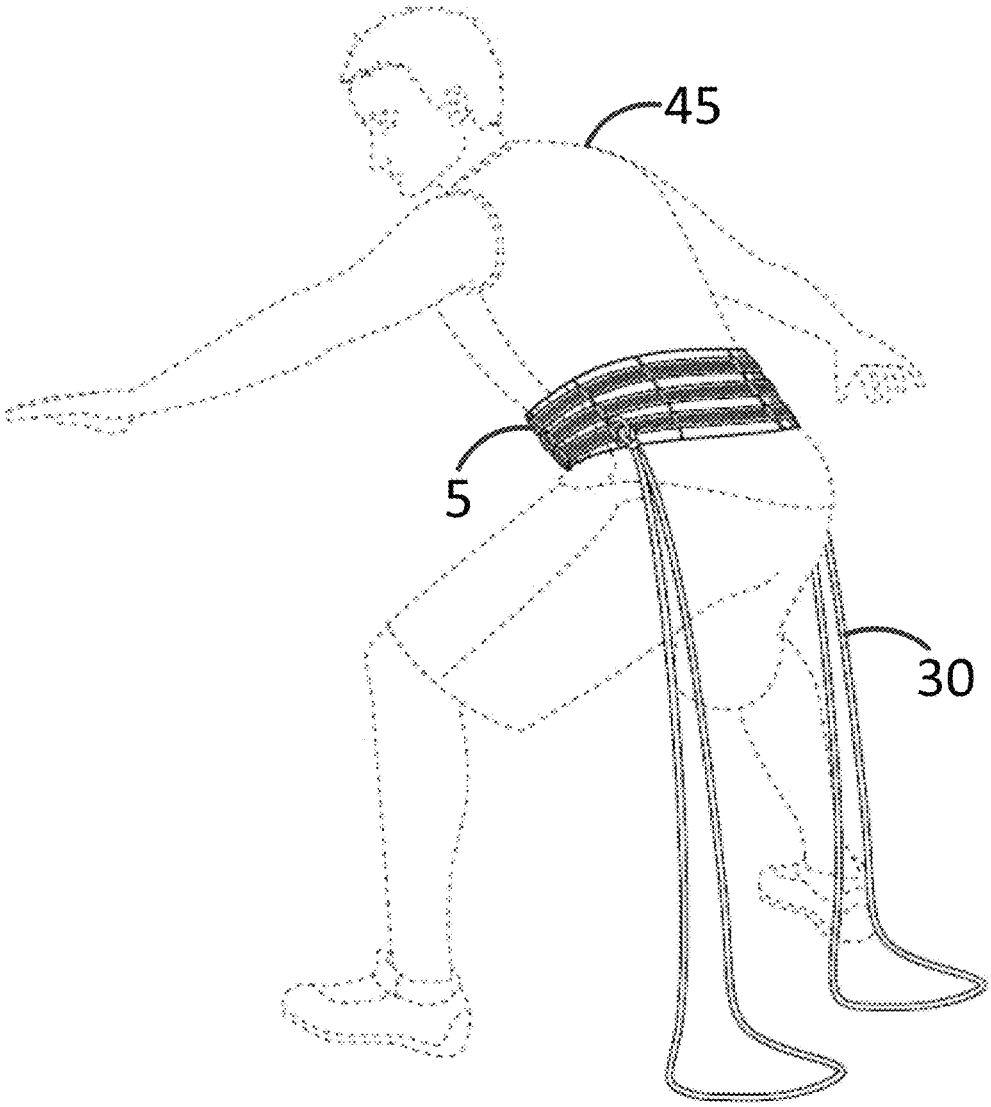
FIG. 6 is a perspective view of the apparatus secured to the midsection of a user during dynamic functional movement, according to embodiments of the present disclosure.
Figure 7:
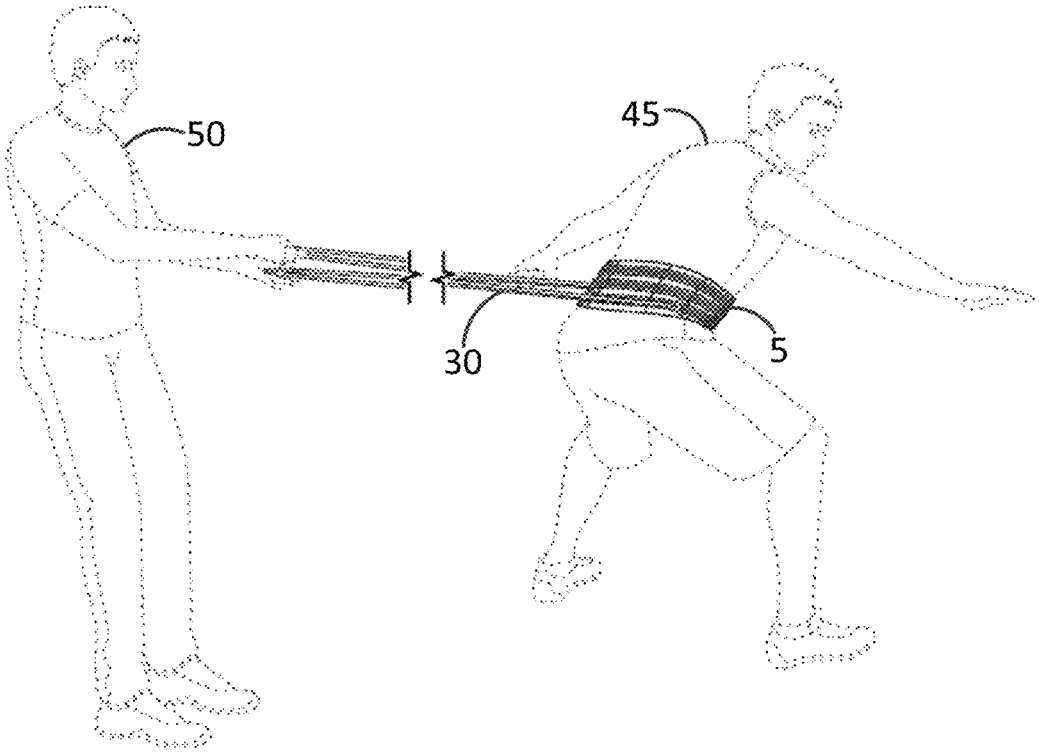
FIG. 7 is a perspective view illustrating the apparatus of FIG. 5 adapted for use with a training partner, according to embodiments of the present disclosure.
Figure 8:
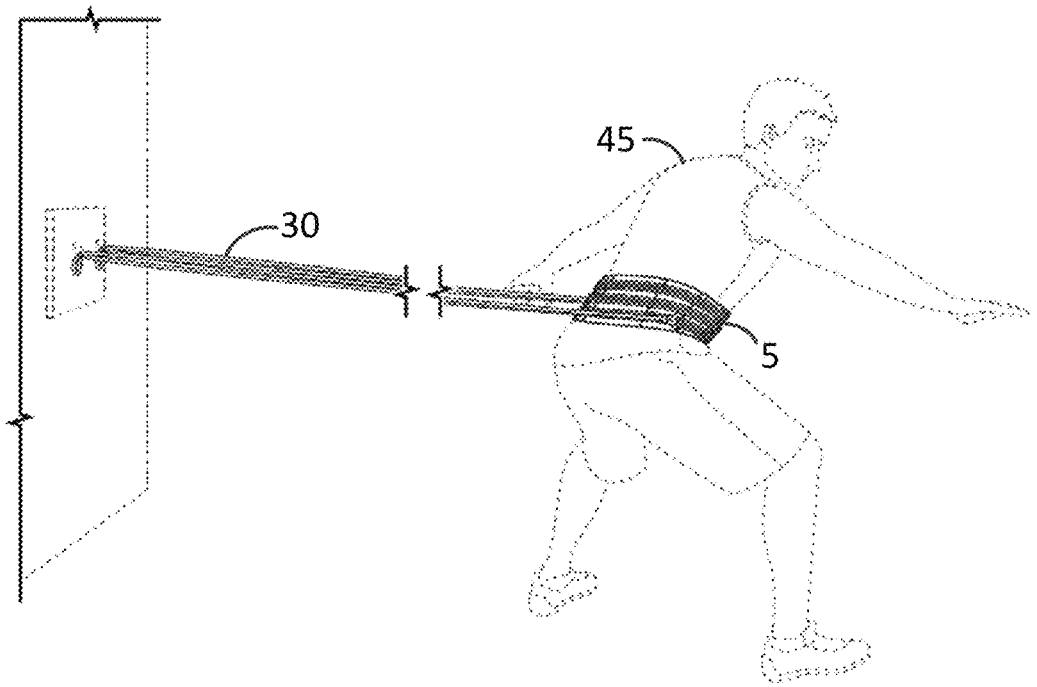
FIG. 8 is a perspective view illustrating the apparatus of FIG. 5 adapted for stationary use.

As shown in FIGS. 5 and 6, the pair of resistance leads 30 are adapted at a first end for attachment to the respective connectors 25. Each resistance lead 30 can simply be looped through or tied to the respective connector 25 or, in other embodiments, the ends of the resistance leads 30 can be adapted with releasable couplers such as spring gate clips, lobster clips, caribiners, or any quick-release type coupler, for example, to allow releasable attachment to the respective connectors 25. The opposite end of the resistance leads 30 remains free and can be adapted for effecting a resistance force against an effort force exerted by the user 45. According to certain embodiments, for example, the free ends of the resistance leads 30 can be adapted to facilitate grasping by a training partner 50 to apply the resistance force to the user 45 wearing the harness 5. For example, the free ends can form a loop (as shown in FIG. 7) or can be fitted with handles to facilitate handling by the training partner 50. In other embodiments, the free ends of the resistance leads 30 can be adapted for fixing to a stationary fixture, such as a wall or a door, wherein the resistance force is effected by the user's effort force exerted against the stationary fixture (FIG. 8). In such embodiments, the apparatus 1 can be adapted to be used by a sole user without the assistance of a training partner 50.

The resistance leads 30 provide resistance force against the user's effort and comprise resistance material, for example resistance tubing, typically made from latex rubber. According to other embodiments of the present disclosure, the resistance leads can be made from silicone. The resistance leads 30 can be provided in various modes of resistance (e.g., tensile strength) depending on the desired intensity of resistance. According to some embodiments, the resistance leads 30 provide sufficient resiliency, which when actuated, can effect vibratory perturbations to the user and in this way offer further stimulatory benefit to the user at the neuromuscular level, for example.

The resistance leads 30 can further be provided in various lengths depending on the particular fitness program desired. According to embodiments of the present disclosure, particularly embodiments for use with a training partner, the resistance leads 30 are long enough to provide sufficient distance between the training partner and the user to provide the user with a wide range of unhindered movement. In this way, the apparatus 1 can be used during dynamic functional movement as well as during sport specific activities. In other embodiments, a shorter length of resistance leads 30 can be used to facilitate use during static positions or during solo use without a training partner, for example. According to embodiments of the present disclosure, the resistance leads 30 are between about 0.5 to about 3 meters in length. In other embodiments, the resistance leads 30 are between about 1 to about 3 meters in length. In further embodiments, the resistance leads 30 are between about 2 to about 3 meters in length.

System

According to certain embodiments, the apparatus 1 can be provided as a system that can be tailored to the needs of the user. In particular, the system can comprise the apparatus 1 as interchangeable accessories that can be assembled as desired. In such embodiments, the system can include various combinations of the harness 5, and interchangeable pairs of resistance leads 30 having differing resistance tensions, and/or lengths, wherein each pair of resistance leads 30 can be interchanged to vary the resistance force being applied to the user as well as to adapt to the particular activity or training program engaged. In other embodiments, the system can also include interchangeable attachments for adapting the free ends of the resistance leads 30 with handles, for use with a training partner, or with attachments for fixing to a stationary fixture for independent use by the user.

Method of Operation—Targeted Muscle Stimulation

Whether used with a training partner or independently by the user, operation of the apparatus 1 of the present disclosure follows the same principles. Accordingly, reference will be made to FIG. 7 without being limited to this particular embodiment. As illustrated, the harness 5 is secured around the midsection of the user 45 and the free ends of the resistance leads 30 are held by the training partner 50. Resistance force is applied or released by the training partner 50 by positioning the resistance leads 30 relative to the user 45 and applying or reducing a desired level of resistance to the user's 45 movement. Specifically, the positioning of the resistance leads 30 relative to the user 45 determines the direction that the resistance force is applied to the user 45. For example, by raising the position of the free ends of the resistance leads 30 a more vertical resistance force will be applied to the user 45. By lowering the position of the free ends of the resistance leads 30 a more horizontal resistance force will result. A lateral force can simultaneously be applied by pulling on one of the free ends at a time to generate a rotational demand that stimulates preferential recruitment of the transversus abdominus muscles of the core. In this way, the apparatus 1 of the present disclosure permits controlled stimulation of the core muscles in a targeted manner that is responsive to the user's movements. Similarly, by adjusting the amount of resistance force applied to the resistance leads 30 will adjust the demand on the muscles being targeted and the intensity of the exercise. Releasing or reducing the resistance force at specific moments of a movement pattern further facilitates optimal movement of the user. In this way, the apparatus 1, allows the intensity, timing, and direction of the stimulation to be adjusted to the needs of the user 45.

According to certain embodiments, the position of the resistance leads 30 can be changed to further vary the type and direction of resistance force applied to the user. For example, both resistance leads 30 can be attached to a connector 25 on one side of the user's body to target the resistance force to specific areas of the user's body. In other embodiments, the position of the user relative to the trainer and/or stationary fixture, as well as the type of exercise or movement being engaged by the user can vary the type and direction of resistance force being applied. In this way, it is contemplated that the apparatus 1 of the present disclosure can be used with various exercise programs that can be specially developed depending on the user's needs and preferences.

The apparatus 1 of the present disclosure also offers flexibility in the environment in which it can be used. According to certain embodiments, the apparatus 1 can be used when the user 45 is in a static position (FIG. 5). For example, the user 45 can be positioned in an athletic neutral position and a resistance force applied by the training partner 50. To maintain balance against the resistance force, muscle recruitment in the user's core muscles are stimulated in a targeted manner. In other embodiments, the apparatus 1 can be adapted for use during dynamic functional movements (FIGS. 6 and 7). Specifically, the design of the apparatus 1 offers the user 45 a wide range of movement that allows the user 45 to freely move while resistance force is applied. As illustrated in FIG. 7, the resistance leads 30 provide sufficient distance between the training partner 50 and the user 45 to allow unhindered dynamic functional movements. In addition, according to certain embodiments, the apparatus 1 can be used during dynamic sport specific activities, for example and without limitation, activities related to basketball, hockey, soccer, golf, and tennis. As well, embodiments of the present disclosure, can be used during dynamic performance arts training including, for example, various forms of dance (break dancing, ball room dancing, creative/modern dancing), martial arts, etc.

Uses

The versatility afforded by the apparatus 1 of the present disclosure allows it to be used in a wide-ranging variety of training programs that can include rehabilitative therapy, general fitness programs, movement therapy, intensive athletic training, and dynamic performance arts training. In particular, the ability to adapt the apparatus 1 for use during both stationary as well as a variety of dynamic activities allows training curriculum to be developed that incorporates the apparatus 1. For example, application of the apparatus 1 in specialized programs, such as progressive training programs and sport specific training programs, is contemplated. As well, incorporation of the apparatus 1 in home-gym or gym fitness programs is further contemplated. Moreover, the versatility of the apparatus 1 to be used during sport specific activities offers core training that is customizable to a particular sport.

It is contemplated that any embodiment discussed herein can be implemented with respect to any method or composition of the invention, and vice versa. Furthermore, compositions and kits of the invention can be used to achieve methods of the invention.

To gain a better understanding of the invention described herein, the following examples are set forth. It will be understood that these examples are intended to describe illustrative embodiments of the invention and are not intended to limit the scope of the invention in any way.

EXAMPLES

Example 1: User-Specific Stationary Core Training Program

The apparatus of the present disclosure is adaptable for use in a variety of personal training programs that are designed to address the lifestyle and physical training requirements of the user. As illustrated in FIG. 8, the apparatus can be adapted for stationary use wherein the user wears the harness and fixes the free ends to a stationary fixture, such as a wall or door. In such applications, the force applied to the user's core is determined by the position of the user relative to the fixed ends, the effort force exerted by the user, and the type of exercise engaged in by the user.

Figure 13:
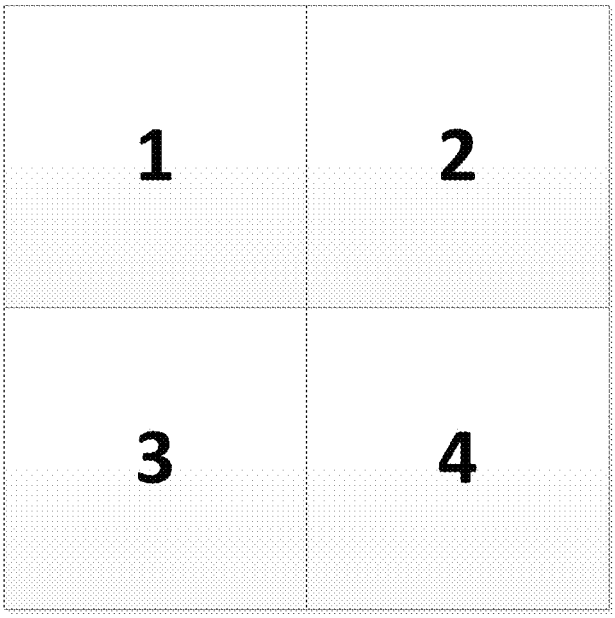
FIG. 13 is a schematic representation of a grid for an exercise program for the apparatus, according to embodiments of the present disclosure.

The user is directed through a personalized exercise routine that includes an exercise grid (as shown in FIG. 13) corresponding to the exercise floor plan. The user is directed through each of the quadrants of the grid where the user will perform exercises specifically designed to target the desired areas of the core muscles.

The particular exercises, repetitions, user positioning relative to the fixed ends (indicated by "X" in FIG. 13) and the quadrant of the grid, as well as the positioning of the resistance leads on the harness, are all variables controlled by the user, in accordance with the designed exercise program, to achieve the desired core training.

The disclosures of all patents, patent applications, publications and database entries referenced in this specification are hereby specifically incorporated by reference in their entirety to the same extent as if each such individual patent, patent application, publication and database entry were specifically and individually indicated to be incorporated by reference.

Although the invention has been described with reference to certain specific embodiments, various modifications thereof will be apparent to those skilled in the art without departing from the spirit and scope of the invention. All such modifications as would be apparent to one skilled in the art are intended to be included within the scope of the following claims.

The embodiments of the invention in which an exclusive property or privilege is claimed are defined as follows:

1. A core muscle training apparatus, comprising:

a harness configured to be worn around a user's midsection, the harness comprising a resilient body-forming material conformable to the user's midsection;

a pair of connectors engaged with an exterior surface of the harness, wherein each of the pair of connectors is positioned on opposite sides of the harness corresponding to sides of a user's waist; and a pair of resistance loops, each of the loops being threadable through one of the connectors such that a slip-knot may be formed connecting the loop to the connector and leaving a free loop hanging from the harness for use in fastening to or around an object or as a handle.

2. The core muscle training apparatus according to claim 1, wherein the harness is a vest.

3. The core muscle training apparatus according to claim 1, further comprising webbing on an interior surface or the exterior surface of the harness for providing structural support to the harness.

4. The core muscle training apparatus according to claim 3, wherein the connectors are fastened to the webbing on the exterior surface of the harness.

5. The core muscle training apparatus according to claim 1, wherein the harness comprises elastomeric fibres selected from the group consisting of neoprene, elastane, and combinations thereof.

6. A core muscle training system comprising:

the apparatus according to claim 1; and at least one additional pair of resistance leads having differing resistance tensions than the other pair;

wherein each pair of resistance leads can be interchanged to vary the resistance force being applied to the user.

7. A method for core muscle training comprising:

providing the apparatus according to claim 1, wherein the harness is worn by the user and the second end of one of the pair of resistance leads is held in one hand by a training partner and the second end of the other of the pair of resistance leads is held in the other hand by the training partner; and the training partner applies a resistance force to each of the pair of resistance leads to stimulate recruitment and activation of core muscles;

wherein a direction that the resistance force is applied is adjusted by a positioning of the resistance leads relative to the user.

8. The method according to claim 7, wherein the resistance force is applied in one or more of a horizontal plane, a vertical plane, a lateral plane, or a rotational plane to stimulate the core muscles in a targeted manner.

9. The method according to claim 7, wherein the resistance force is applied during a static positioning of the user.

10. The method according to claim 7, wherein the resistance force is applied during a dynamic functional movement of the user.

11. The method according to claim 10, wherein the dynamic functional movement is a sport specific activity.

12. A method for core muscle training comprising:

providing the apparatus according to claim 1, wherein the harness is worn by the user and the second end of each of the resistance leads is fixed to a stationary fixture;

providing an exercise grid having quadrants; and directing the user through each of the quadrants of the exercise grid, the user performing exercises targeting core muscles in each of the quadrants;

wherein a resistance force applied to the user's core is determined by a position of the user relative to fixed ends of the resistance leads and the quadrants of the exercise grid.

13. A core muscle training apparatus, comprising:

a harness configured to be worn around a user's midsection, the harness comprising a resilient body-forming material conformable to the user's midsection;

webbing on an exterior and/or interior surface of the harness for providing structural support to the harness;

a pair of connectors fastened to webbing on the exterior surface of the harness located at opposing lateral sides of the user's midsection; and a pair of resistance loops, each of the loops being threadable through one of the connectors such that a slip-knot may be formed connecting the loop to the connector and leaving a free loop hanging from the harness for use in fastening to or around an object or as a handle.

* * * * *